United States Patent [19]

Carroll et al.

[11] 4,106,623

[45] Aug. 15, 1978

[54] THREE-LEVEL STACKING CONTAINER

[75] Inventors: James C. Carroll, Hopkinsville, Ky.; Lewis T. Johnson, Bartlesville, Okla.

[73] Assignee: Phillips Petroleum Company, Bartlesville, Okla.

[21] Appl. No.: 824,578

[22] Filed: Aug. 15, 1977

[51] Int. Cl.[2] ..... B65D 21/04; B65D 21/06

[52] U.S. Cl. ..... 206/506; 206/507

[58] Field of Search ..... 206/505, 506, 507; 211/126

[56] References Cited

U.S. PATENT DOCUMENTS

| | | | |
|---|---|---|---|
| 2,747,748 | 5/1956 | Barefoot | 211/126 |
| 2,765,099 | 10/1956 | Lively | 206/506 |
| 3,163,296 | 12/1964 | Hohnstein | 211/126 |
| 3,219,232 | 11/1965 | Wilson | 206/505 |
| 3,375,953 | 4/1968 | Miller | 206/506 |
| 3,379,339 | 4/1968 | Asenbauer | 206/506 |
| 3,392,875 | 7/1968 | Bockenstette | 206/507 |
| 3,420,402 | 7/1969 | Frater | 206/507 |
| 3,586,205 | 6/1971 | Van Daalen | 206/506 |
| 3,934,724 | 1/1976 | Johnson | 206/507 |
| 3,951,265 | 4/1976 | Carroll | 206/506 |

FOREIGN PATENT DOCUMENTS

| | | | |
|---|---|---|---|
| 2,286,062 | 4/1976 | France | 206/506 |
| 107,627 | 12/1965 | Norway | 206/506 |

*Primary Examiner*—George E. Lowrance

[57] ABSTRACT

A three-level stacking container adapted to stack within a lower container of like construction in a low-level stack position or an intermediate-stack position, or stack on said lower container in a high-stack position, depending upon the orientation of said upper container with respect to said lower container. Opposing first and second wall structures of said container comprise bar members which extend in an upwardly direction between a lower border flange and an upper rim. Said bar members are arranged such that the bar members of an upper container parallel the bar members of a lower container when said upper container is stacked within said lower container.

27 Claims, 11 Drawing Figures

THREE-LEVEL STACKING CONTAINER

This invention relates to a three-level stacking container.

Nesting and stacking containers are well known in the art. In general, such containers comprise an open top, commonly rectangular, container so constructed that in one position of orientation an upper container will nest within a like oriented identical lower container for storage purposes. Commercially available nest and stack containers of the prior art commonly nest substantially completely within another like container. This is desirable for storage purposes, but is of little value for utility. When an upper container is rotated to another position of orientation it will stack vertically on said lower container, usually on top or essentially on top of the lower container.

Nest and stack containers are being employed in increasing numbers in a wide variety of applications such as product containers in the baking industry, lug boxes in the fruit and vegetable industry, storage bins for parts, etc. In many of these uses it will be desirable to have a container which can be usefully stacked with another container at more than one level or elevation. Such a container would have much greater utility than a container which can be stacked on another container at only one level or elevation.

The present invention solves this problem by providing a container which can be usefully stacked with another like container at three different levels or elevations. For example, in one position of orientation of an upper container with respect to a like lower container, an upper container of the invention will stack within a said like lower container at a low-stack position or relationship. In this position the bottom of the upper container is above the bottom of the lower container a significant distance sufficient to provide worthwhile utility for transporting products having a low height. Then, in a second position of orientation said upper container will stack within said lower container in an intermediate-stack position or relationship. In this position the bottom of the upper container is above the bottom of the lower container a greater distance, leaving more room for products having a greater height. Means are also provided for stacking an upper container on top of a lower container. In this position maximum utilization of the container interior is possible. Thus, for example, a bakery operator can employ the containers of the invention in multiple uses, and eliminate the need for stocking several different types of containers for different types of products. Other advantages of the containers of the invention will be discussed below in connection with the more detail description of the containers.

A three-level stacking container somewhat similar to the present invention is disclosed and claimed by James C. Carroll in U.S. Pat. No. 3,951,265 issued Apr. 20, 1976. In the container of the present invention, however, the means for stacking an upper container on top of a lower container in a high stack position is of a different and unique construction which provides advantages not possessed or suggested by the container disclosed in U.S. Pat. No. 3,951,265. Other novel features and advantages of the present invention will be apparent from the following disclosure and the accompanying drawings.

According to the present invention, there is provided a generally rectangular container capable of three-level stacking with a like container, said container comprising a generally horizontally disposed bottom; opposed first and second sidewalls respectively projecting upwardly from first and second opposed sides of said bottom. Each of the first and second sidewalls comprises a lower border flange, an upper rim, and a plurality of bar members extending in an upwardly direction between said flange and said rim. Each of the first and second sidewalls also comprises a plurality of spaced-apart stacking feet on the outer surface of the sidewall bottom flange and a plurality of stacking saddles on the inner surface of the sidewall rim. Each of the first and second sidewalls also comprises a pivotable bar means which extends along and is mounted to said first and second sidewall rims. The pivotable bar means is capable of resting upon at least some of the stacking saddles inside the rim to which it is mounted and is of such dimensions that when said bars means so rests upon said stacking saddles, another like oriented or reversely oriented like container will stack upon the container in a high stack position. The pivotable bar means are further characterized in being capable of being pivoted to a point which will allow a like container to be stacked in said container in either a low stack or intermediate stack position. The location, arrangement, and directional disposition of said bar members of said first wall structure and said bar members of said second wall structure with respect to each other and with respect to the locations and spacings of said stacking feet and stacking saddles are such that an upper said container will stack within a like lower container and on said border flange thereof in a low stack position when said upper container is in one of the positions of (1) identical orientation with respect to said lower container or (2) rotated orientation with respect to said lower container; and said stacking feet and said stacking saddles of said wall structures being adapted to register and support an upper said container within a like lower container in an intermediate stack position when said upper container is in the other of said positions (1) and (2).

In addition to the first and second opposed sidewalls, the container of this invention can have a third sidewall extending upwardly from a third side of the bottom, or third and fourth opposed sidewalls extending upwardly from the third and fourth opposed sides of the bottom. The only requirement on these additional sidewalls is that they not prevent the stacking of two such containers in the low stack, intermediate stack, and high stack position, as above described.

The pivotable bar means associated with said first and second sidewalls can comprise one pivotable bar or a plurality of suitable pivotable bars. The bar means can be allowed to pivot from its position of resting upon the stacking saddles outward until it contacts the outer surface of the respective sidewall rim or to any suitable point less than that which would result in its contacting the outer surface of said respective sidewall rim. In a preferred embodiment, the pivotable bar means is adapted to pivot outwardly in the range of about 120° to about 180° from its position of resting upon said stacking saddles. In an especially preferred embodiment, the pivotable bar means is adapted to pivot outwardly from resting upon said stacking saddles no less than 90° and no more than about 120°. It is also within the scope of this invention to have said bar means pivot only from resting upon said stacking saddles to a vertical position.

Additional understanding of the present invention and the advantages of various embodiments will be provided by a study of the accompanying FIGURES.

Figure 1:
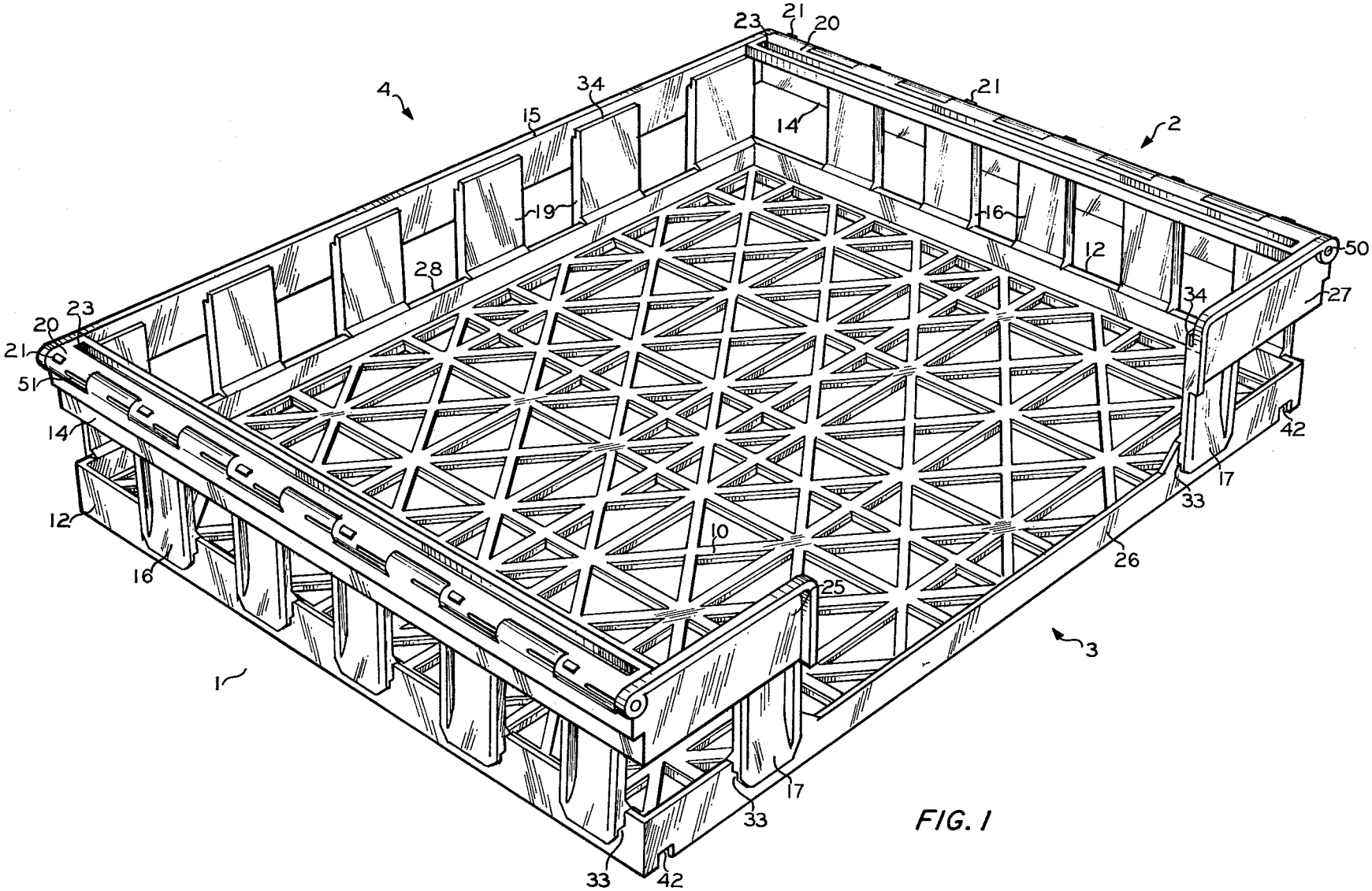
FIG. 1 is a top perspective view of one presently preferred container of the invention.

In the FIGURES like reference numerals are employed to denote like elements. The container illustrated in FIG. 1 is a generally rectangular container having four sidewalls, one of which is lower in its central portion than the other three. In this embodiment, the bottom 10 comprises a gridwork. It should be noted that it is within the scope of this invention to employ any other suitable bottom means such as a planar sheet, a perforated planar sheet, etc.

The container illustrated in FIG. 1 has first and second opposed sidewalls 1 and 2 which project upwardly from opposing first and second sides of said bottom 10. Each of said first and second sidewalls comprises a border flange 12 in a first vertical plane which extends along the respective side of said bottom and projects upwardly above the plane of the upper surface of the bottom and downwardly below the plane of the lower surface of the bottom. See FIGS. 6 and 7. Disposed generally vertically above each said border flange 12 is an upper rim 14 in a second vertical plane outside and parallel to that of said first vertical plane. Extending between the border flange 12 and the upper rim 14 are a plurality of spaced-apart bar members 16 which extend vertically in an upwardly direction from the outer surface of the border flange 12 to the inner surface of the upper rim 14. The plurality of bar members 16 are thus disposed in a third vertical plane which is located adjacent but outside (with respect to the container) said first vertical plane.

The bar members 16 of sidewall 1 are of such size and are so spaced with respect to the bar members 16 of sidewall 2 that when another like container is placed inside said container in reverse orientation thereto the bar members of the sidewalls of the upper container will be received into the spaces between the bar members in the lower container to allow low stacking, and when another like container is placed inside said container in like orientation the bottoms of the bar members of the upper container will rest on the tops of bar members of the lower container to provide intermediate stacking.

With such an arrangement, the bottoms and the tops of the bar members 16 comprise stacking feet and stacking saddles, respectively. In the container illustrated in FIG. 1, the bottoms of said bar members 16 are provided with an upwardly extending downwardly open recess 33. Also the tops of said bar members 16 are provided with an elevated crown 34 for registering in recesses 33 in the bottoms of said bar members 16 of a like container.

It should be noted that it is within the scope of the invention for said plurality of stacking feet to be provided at locations other than on the lower ends of said bar members. For example, the number of said bar members can be reduced and a stacking foot only provided on said border flange, e.g., at location(s) here illustrated as occupied by a bar member. Similarly, said plurality of stacking saddles can be provided at locations other than on the lower ends of said bar members. For example, the number of said bar members can be reduced and a stacking saddle only provided at location(s) here illustrated as occupied by a bar member. If stacking saddles and stacking feet are provided at locations other than on the tops and bottoms, respectively, of said bar members, it is preferred that they be provided respectively with crowned structure 34 and recessed structure 33 as in the container illustrated in FIG. 1.

The container illustrated in FIG. 1 also contains third and fourth opposed sidewalls 3 and 4 extending along the respective third and fourth opposite sides of said bottom 10. The sidewall 4 includes a border flange 28 which extends along the fourth side of said bottom 10. The sidewall 3 includes a border flange 26 which extends along the third side of the bottom 10. The lowermost portions of the border flanges 26 and 28 throughout their length, with the exception of the portions including grooves 42, lie in the same horizontal plane as the lowermost portions of the border flanges 12. The significance of the grooves 42 will be described in more detail below. The uppermost portions of border flanges 12 and 28 throughout their length lie in the same horizontal plane. Border flange 26, i.e., the third sidewall border flange, has a central portion of its length lower than the uppermost portions of the border flanges 12 and 28. The end portions of border flange 26 are, however, of the same height as the border flanges 12 and 28.

It is to be noted that arrangement of border flanges in the container illustrated in FIG. 1 is just a preferred embodiment. None of the border flanges need project either above or below the bottom of the container. The border flanges can thus be merely the sides of the bottom. Preferably, however, the border flanges of at least the first and second sidewalls extend below the lower surface so that said flanges can cooperate with the pivotable bar to provide an especially preferred means of stacking one such container in a high stack position on another; such preferred high stacking means will be described in more detail below.

Turning back to the specific container illustrated in FIG. 1, it will be noted that the sidewall 3 includes a pair of partial upper rim members 25 and 27 disposed above and in a second vertical plane outside the first vertical plane in which said border flange 26 lies. Partial upper rim member 25 adjoins upper rim 14 of sidewall 1 and partial upper rim member 27 adjoins upper rim 14 of sidewall 2. Each said partial upper rim member is of such length that it does not extend over the low central portion of the border flange 26. Each partial upper rail member, adjacent the end opposite the end which adjoins the respective first or second side, has a vertically disposed bar 17 extending from its inner surface to the outer surface of border flange 26 in a third vertical plane.

The sidewall 4 includes an upper rim 15 disposed above and in a second vertical plane outside the first vertical plane in which border flange 28 is disposed. Extending between border flange 28 and upper rim 15 are a plurality of spaced-apart bar members 19 which extend in an upwardly direction in a third vertical plane from the outer surface of border flange 28 to the inner surface of upper rim 15. The plurality of bar members 19 are of such size and are so spaced with respect to the bar members 17 of said sidewall 3 that when another like container is placed inside said container in reverse orientation thereto, the bar members 17 of the lower container will be received into the spaces between the bar members 19 of the upper container and the bar members 17 of the upper container will be received into spaces between bar members 19 of the lower container so that the two containers can be positioned in the low stack position. The bar members 19 and 17 are also of such size and are so spaced that when another like container is placed upon said container in like orientation, the bottoms of bar members 19 of the upper containers will rest on the tops of bar members 19 of the lower container and the bottoms of bar members 17 of the upper container will rest on the tops of the bar members 17 of the lower container to allow intermediate stacking.

In the container illustrated in FIG. 1, the bar members 19 and 17 have on their bottoms recesses 33 and on their tops elevated crowns 34 as provided for bar members 16.

The first and second opposed sidewalls 1 and 2 each have a pivotable bar means 20 extending along and mounted to the respective sidewall rim 14. The pivotable bar means 20 is capable of resting in a horizontal position upon the stacking saddles of the bars 16 of the respective sidewall. The bar means 20 includes stop means 21 which prevent the bar means from being pivoted outwardly more than about 120° from the above-described horizontal position. Such an arrangement has been found to possess especially desirable utility.

It is not uncommon for containers to be placed upon a conveyor means for continuous filling and transportation to some point for stacking. Containers of this invention having bar means 20 adapted to pivot outwardly only about 120° from the horizontal can be placed upon a conveyor with the bars pivoted outwardly without any likelihood that the vibration caused by the conveyor will cause the bars to fall into their horizontal position before the container is filled. Also the 120° pivotable nature of the bar means makes it a very simple matter to associate means with a conveyor which, after the filling of the conveyor, will cause the bar means to be automatically pivoted to their horizontal position so that such containers can be stacked in the high stack position as desired. It should be recognized that the container illustrated in FIGS. 1–7 is only one preferred embodiment of the present invention. As indicated above, the pivotable bar of the container of this invention can be adapted to pivot from its horizontal position to any position which allows a like container to be stacked in the container in either the low stack or intermediate stack position. It should also be noted that the stop means 21 in the container of FIG. 1 could be replaced partly or totally by suitable stop means on the upper rim of the respective first and second sidewalls. In yet another embodiment, the stop means could be dispensed with entirely, resulting in a container in which the bar is adapted to pivot outwardly so that it rests flush against the outer surface of the respective upper rim.

In the container illustrated in FIGS. 1–7, the bar means 20 includes a slot 23. The slots 23 and the aforementioned grooves 42 are so positioned that when said bar means 20 is in its horizontal position, the bottom of the border flanges of the first and second sidewalls of another like container can be fitted inside the slots 23. Such an arrangement assures a more stable high stack arrangement, which is particularly important when one is handling large numbers of such high-stacked containers. Since in the container illustrated in FIG. 1 the border flanges of all four sides extend downwardly to the same extent, it will be recognized that the grooves 42 are necessary if the border flanges 12 were to fit inside the slots 23. Of course, if the border flanges 26 and 28 of the upper container did not extend downwardly as far as the border flanges 12, the grooves 42 would be unnecessary for such stacking.

While in the container of FIG. 1, the pivotable bar means 20 includes slots 23, it is to be recognized that it is within the scope of this invention to employ any suitable solid pivotable bars which in the horizontal position will support another like container in a stacked position higher than that of the intermediate stacked position. Thus a bar without a slot can be employed.

The pivotable bar means in the container of FIG. 1 pivots around a pin 50 which extends through said bar means 20 and into sidewalls 3 and 4. The structure showing how a passageway is provided through the bar means 20 for the pin 50 is best illustrated by referring to FIGS. 1 and 6. Each hinging portion of the bar means 20 contains two slots 51. The two slots 51 are on opposite sides of the hinge portion of the bar means 20. They each extend only part of the length of the hinge portion to a point where they meet. This structure thus provides a passageway for the pin 50 without having to mold or drill such through each of the hinge portions of the bar means 20. It is to be recognized that it is within the scope of the present invention to make the bar means pivotable by any known technique.

Figure 2:
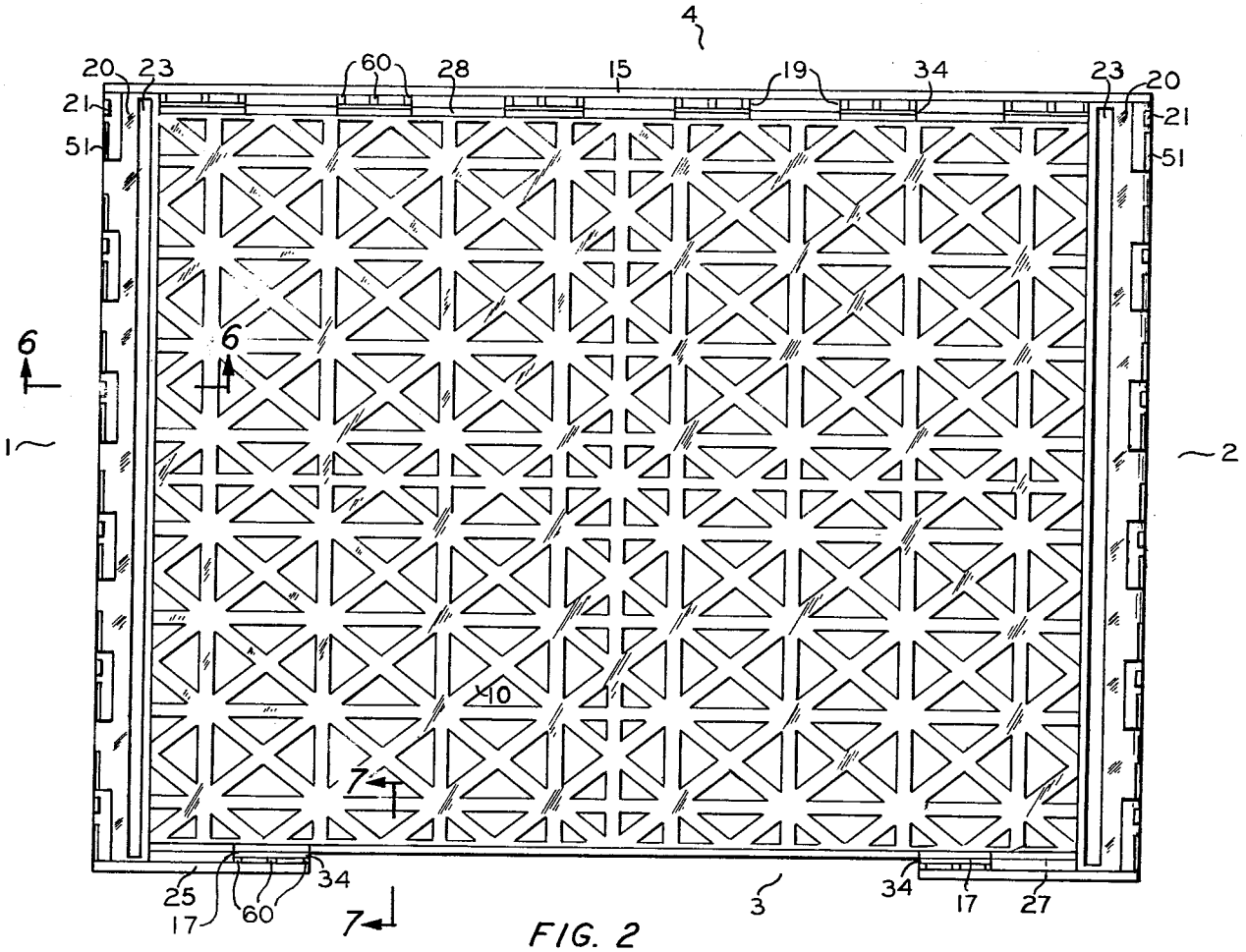
FIG. 2 is a top plan view of the container of FIG. 1.
Figure 3:
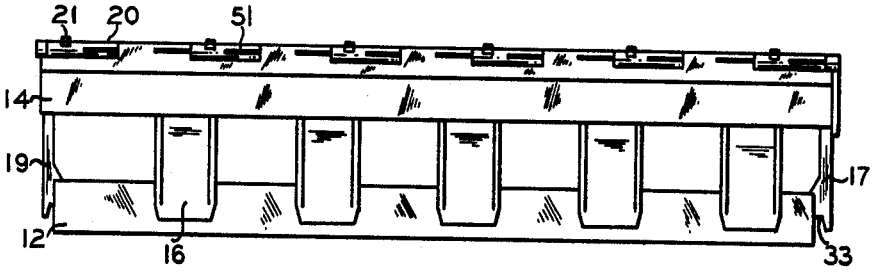
FIG. 3 is an elevation view of the first sidewall of the container of FIG. 1.
Figure 4:
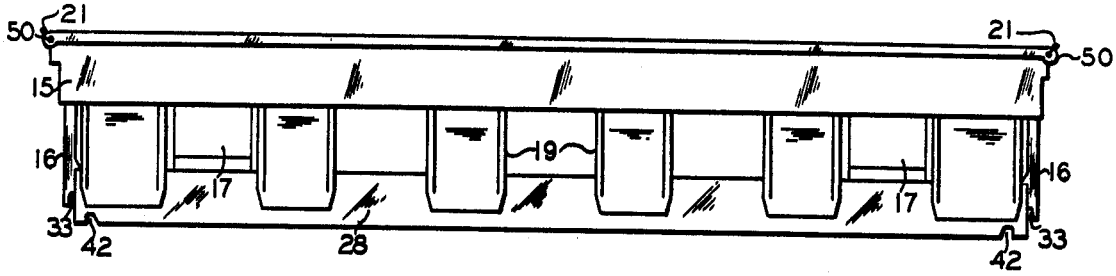
FIG. 4 is a side elevation view of the fourth sidewall of the container of FIG. 1.
Figure 5:
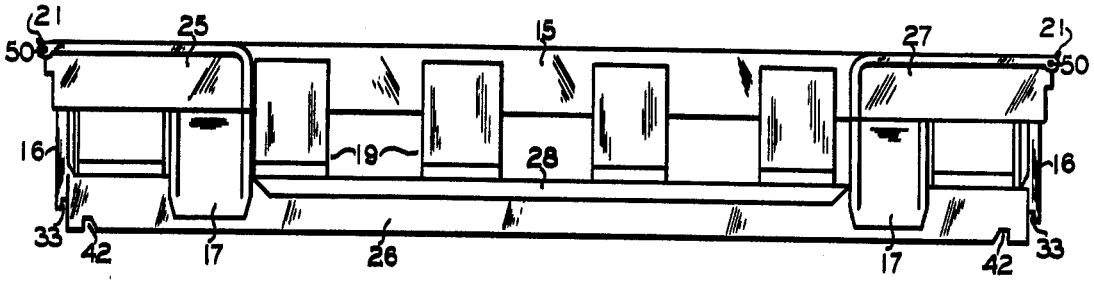
FIG. 5 is a side elevation view of the third sidewall of the container of FIG. 1.
Figure 6:
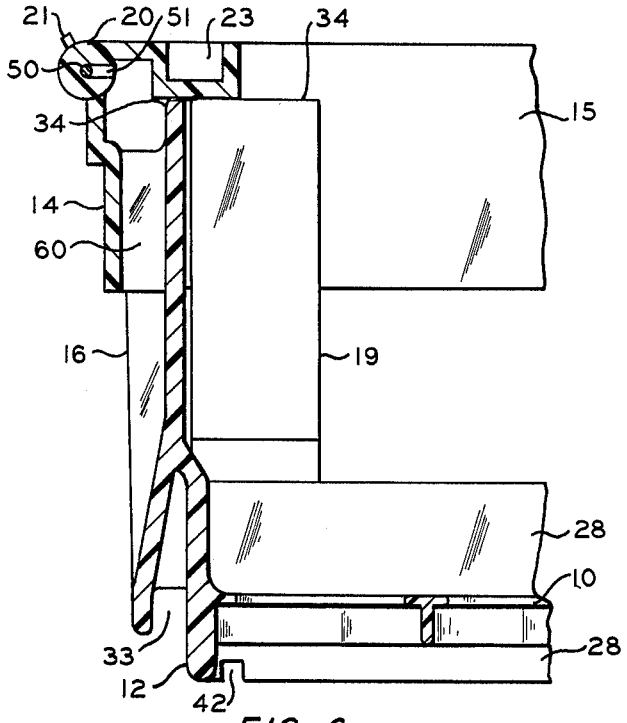
FIG. 6 is a sectional view taken along the line 6—6 of FIG. 2.
Figure 7:
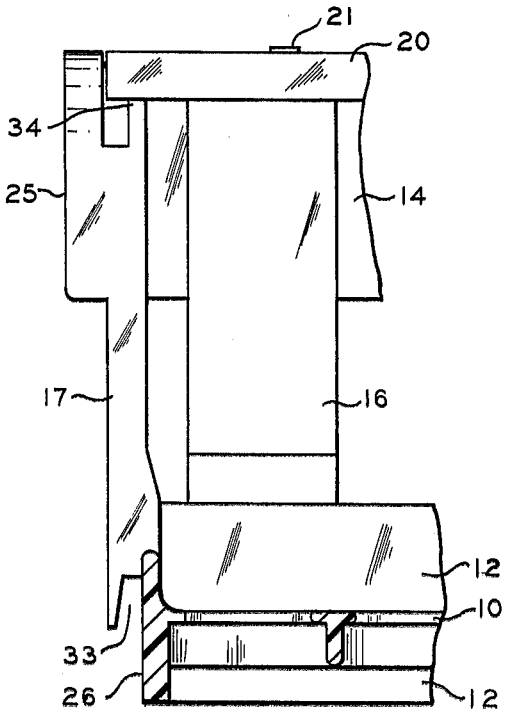
FIG. 7 is a sectional view taken along the line 7—7 of FIG. 2.

Attention is now directed to item 60 of FIGS. 2 and 6. It will be noted in FIG. 2 that each bar member 17 of sidewall 3 and each bar member 19 is connected to the upper rim 14 by means of three vertical webs 60. Although not visible in FIG. 2 because of the placement of the pivotable bar means, preferably each of the bar members 16 of sidewalls 1 and 2 would be similarly attached to the upper rim 14. One of the webs 60 in sidewall 1 is shown in FIG. 6. By connecting the bar members 16, 17, and 19 to the upper rim in this manner, one obtains a container that is more easily cleaned than one in which the bar members are connected to the upper rim by total contact with said upper rim throughout the total width of the bar member. Such a technique would provide surface for the trapping of undesirable materials during a washing operation.

Figure 8:
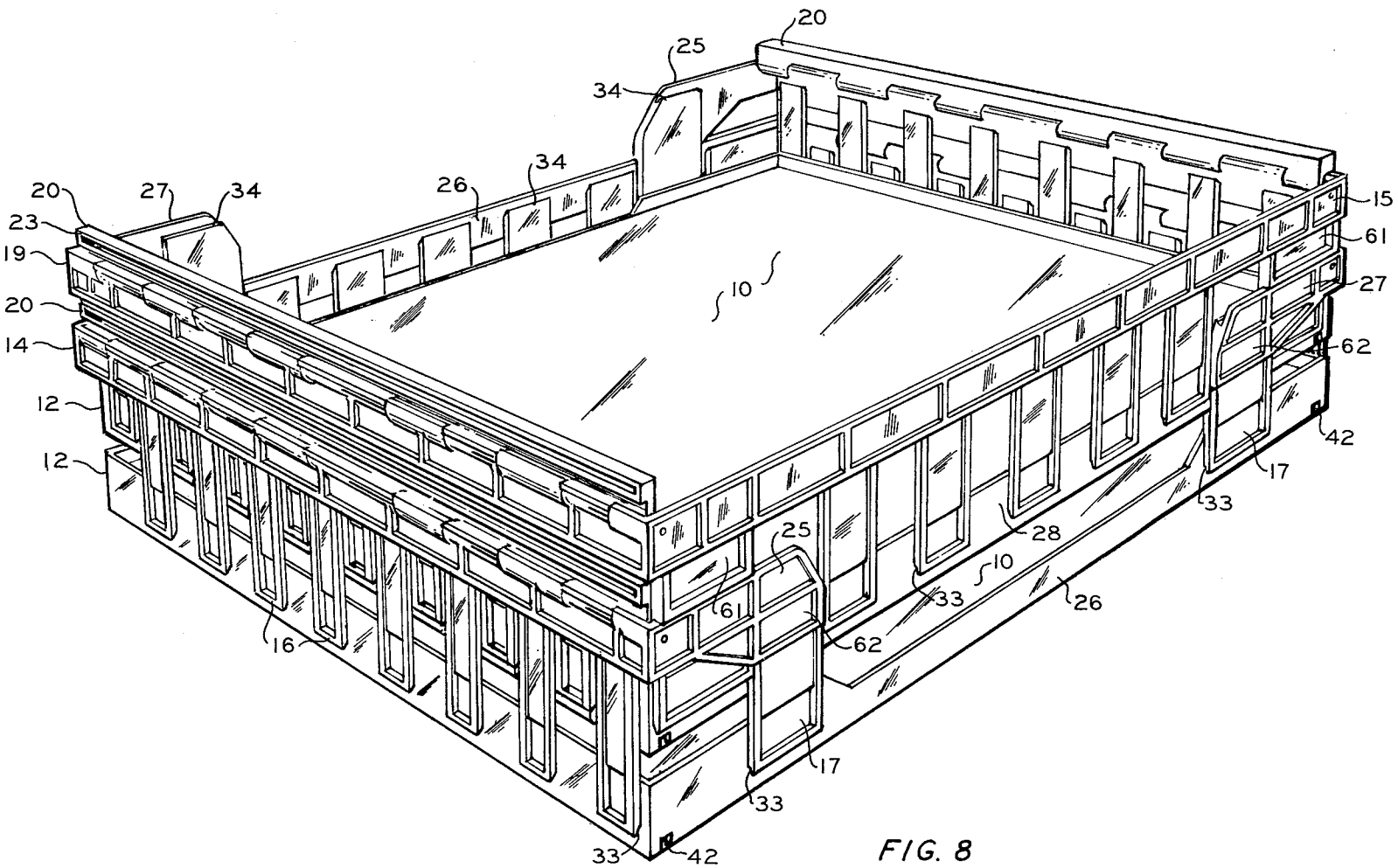
FIG. 8 is a top perspective view of two other containers of this invention in the low stack position.

Another embodiment of the present invention is illustrated in FIG. 8, which shows two inventive containers in the low stack position. In the containers of this embodiment, the pivotable bar 20 is adapted to move only from the horizontal position to a vertical position. With such containers in the low stacking position, the lower portion of the upper rims 14 of the upper container contacts the upper portion of the vertically disposed pivotable bar means 20 of the lower containers. The upper rim 15 of sidewall 4 has depending portions 61 such that with such containers in the low stacking position, the lowermost portions of the upper rim 15 of the upper container rest upon the uppermost portions of the partial rim members 25 and 27 of the lower container. Also, the partial upper rim members 25 and 27 have depending portions 62 such that with such containers in the low stacking position the lowermost portions of the partial upper rim members of the upper container each rest upon the uppermost portions of the rim 15 of the lower container. Such an arrangement allows weight in the upper container to be more evenly distributed over the lower container than if the weight of the upper container were supported solely by the vertically disposed pivotable bar members of the lower container.

Figure 9:
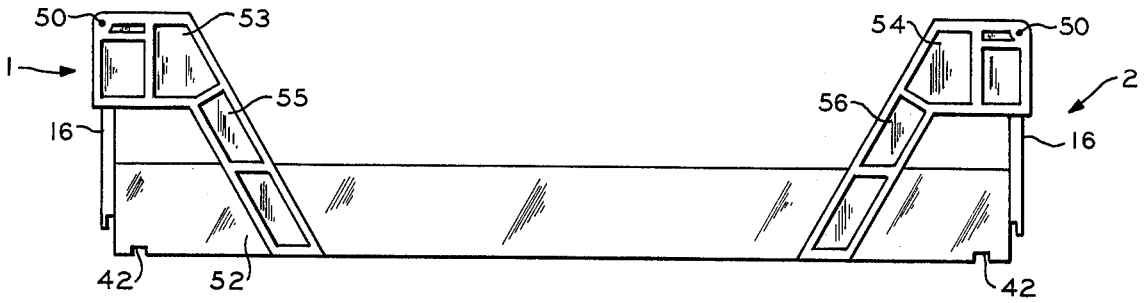
FIG. 9 is an elevational view of another type of sidewall that can be employed as third or fourth sidewalls in containers of the instant invention.

Instead of employing sidewalls 3 and 4 of the type possessed by the container of FIG. 1, it is also within the scope of the present invention to have sidewalls 3 and 4 be of the type illustrated and described as the sides extending along the third and fourth sides of the bottom in the container of the aforementioned U.S. Pat. No. 3,951,265. Such a sidewall is illustrated in FIG. 9 of the instant disclosure. The sidewall of FIG. 9 includes a border flange 52 extending along the respective side of the bottom, a pair of partial upper rim members 53 and 54 disposed above and in a vertical plane outside the plane in which the border flange lies, one of said partial upper rim members adjoining the upper rim of sidewall 2 and the other adjoining the upper rim of sidewall 1, and a pair of inclined brace members 55 and 56 each lying in the same vertical plane as the partial upper rim members and extending from the end of the partial upper rim members opposite that which adjoins the respective first and second sidewall downward toward the other to adjoin the border flange. Of course positioning of the brace members 53 and 54 would have to be such that a like container could be placed inside said container in a reverse orientation to obtain a low stack position.

Further, while the bar members 16, 17, and 19 in the containers illustrated in FIGS. 1–8 are vertically disposed, it is also within the scope of the present invention to employ inclined bar members such as those illustrated in FIGS. 14–16 of U.S. Pat. No. 3,951,265 and FIGS. 2–5 of U.S. Pat. No. 3,934,724, the disclosures of which are incorporated herein by reference.

Preferably, if inclined bar members are employed, at least some are successively inclined in opposite directions with respect to each other, with adjacent bar members being joined at the adjacent ends thereof to provide a series of alternate generally V-shaped forms and inverted generally V-shaped forms.

When adjacent inclined bar members are joined at adjacent ends thereof to form such V-shaped forms and inverted V-shaped forms, the apex area of each said inverted generally V-shaped form can comprise a stacking saddle to provide a plurality of stacking saddles at spaced-apart locations along the respective upper rim. The upper end of any single inclined bars can also comprise a stacking saddle. Similarly, the apex area of each of said generally V-shaped form can comprise a stacking foot to provide a plurality of stacking feet at spaced-apart locations along the respective border flange. The lower ends of single inclined bars can also comprise a stacking foot.

Figure 10:
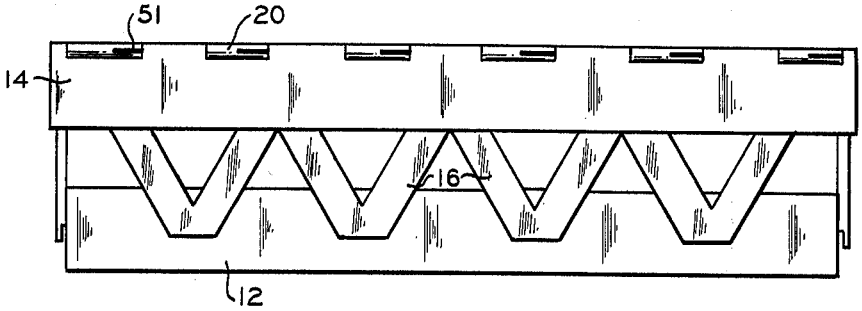
FIGS. 10 and 11 are elevational views of opposite first and second sidewalls of a container of the instant invention which allows low stacking of like oriented like containers and intermediate stacking of reversely oriented like containers.
Figure 11:
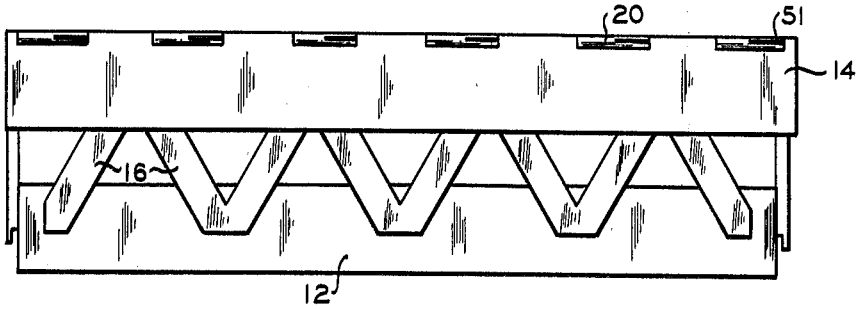

The inclined bar members in such an embodiment are positioned such that a like oriented like container can stack inside such a container in a position lower than the intermediate stack position, to be described. The inclined bar members are further positioned such that when a reversely oriented like container is placed in such a container, it will be supported in an intermediate stacking position in which stacking feet of the upper container rest in stacking saddles of the lower container. FIGS. 10 and 11 illustrate opposite end walls of the type just described.

Preferably, when inclined bars are employed, each stacking foot is provided with a recess and each stacking saddle is provided with a crown as described above in connection with containers having sidewall bars which are vertical rather than inclined.

It should be noted that by varying the placement and/or dimensions of one or more of the components of the sidewalls of containers of this invention, i.e., the border flange, the upwardly directed bars, the upper rim, the pivotable bar, it is possible to obtain containers having different low, intermediate, and high stacking heights. In one preferred embodiment of containers having vertically directed sidewall bars, the containers' sidewall components are arranged such that when a first container has a like second container stacked therein in the low stack position and then a third like container is placed in the second container in reverse orientation to that second container, the bottom of the bars of the third container will fit down in said second container the same distance as the second container sits down in the first container. In other words, such preferred containers are constructed so that when three such containers are stacked in the low stack position the stacking feet of the third, or uppermost, container and the stacking saddles of the first container, or lowermost container, do not contact in a way which would cause the third container to be unable to fit down in the second container as far as the second container fits down in the first container. Any number of such containers can be so stacked so long as alternate upper containers are rotated 180° with respect to the adjacent lower container.

It is, however, also within the scope of the invention to produce containers having vertically directed sidewall bars, which containers are constructed so that when three such containers are stacked with each in reverse orientation to the immediately lower container, the stacking feet on the bars of the third, or uppermost, container contact the stacking saddles on the first, or lowermost, container so that said third container does not fit down into said second container as far as the second container fits down into the first container. Even with this type of container, any number can be so stacked so long as alternate upper containers are rotated 180° with respect to each other. From this it should be understood that the term "low stacking position" is used herein to denote any position in which the lower surfaces of the stacking feet of an upper container are lower than the upper surfaces of the stacking saddles of an immediately lower container.

The stacking of the containers of the invention provided with inclined bar members in the opposing first and second wall structures thereof differs from that of the containers of the invention provided with vertical bar members in said wall structures. Said containers of the invention having inclined bar members in said wall structures will stack at said low-level stack position, e.g., with the bottoms of the border flanges of the upper container registering with the tops of the border flanges of the lower container when said upper container is in a position of like orientation with respect to the lower container. Any number of the containers can be so stacked so long as the upper container is in said position of like orientation with respect to the lower container. The V-shaped forms coincide with each other with the inclined bar members comprising said V-shaped forms paralleling each other. The use of inclined bar members permits the low-level stack height to be less than one-half the intermediate-level stack height.

The containers of the invention provided with said inclined bar members in said wall structures thereof will stack at said intermediate-level position on the tops of the inclined bars, e.g., the apex areas formed by joining of adjacent ends of adjacent bars, when an upper container is in rotated orientation, i.e., 180°, with respect to a lower container. Any number of said containers can be so stacked so long as alternate upper containers are rotated 180° with respect to the adjacent lower container.

The containers of the invention provided with said inclined bar members in said wall structures thereof will stack at the high-level stack position in the same manner as described above in connection with the containers having vertical bar members in said wall structures thereof.

From the above descriptions of the containers of the invention, and the stacking features thereof, it is clear that the location, arrangement, and directional disposition of said bar members of said first wall structure and said bar members of said second opposing wall structure, with respect to each other, together with the location, arrangement, and lateral spacing of said stacking feet and said stacking saddles in said first wall structure, and said stacking feet and said stacking saddles in said second wall structure, with respect to each other, are such that an upper said container will stack within a like lower container and on the border flange thereof in a low-stack position or relationship when said upper container is in one of the positions of (1) identical orientation with respect to said lower container and (2) rotated orientation with respect to said lower container, and an upper said container will stack within a like lower container in an intermediate-stack position or relationship when said upper container is in the other of said positions (1) and (2).

The containers of the invention can be fabricated in any suitable manner known to the art. Injection molding, for example, is one presently preferred method for fabricating said containers. Said containers can be fabricated from any suitable material. High density polyethylenes are especially desirable materials from which to fabricate said containers. The high density polyethylenes prepared by the methods disclosed and claimed by J. P. Hogan et al in U.S. Pat. No. 2,825,721, issued Mar. 4, 1958, comprise one group of presently preferred materials. Said containers can also be fabricated from butadiene-styrene copolymers and other plastic materials. If desired, a reinforcing fibrous material, such as asbestos or glass fibers, can be incorporated in the plastic material. While the various plastics are presently preferred for the manufacture of the containers, it is within the scope of the invention to fabricate said containers from other materials, e.g., lightweight metals such as aluminum, reinforced pulp materials, etc.

Herein and in the claims, the word "rectangular" has been employed generically to include four-sided structures which are generally square and four-sided structures wherein one pair of sides is longer than the other pair of sides.

While certain embodiments of the invention have been described for illustrative purposes, the invention is not limited thereto. Various other modifications or embodiments of the invention will be apparent to those skilled in the art in view of this disclosure. Such modifications or embodiments are within the spirit and scope of the disclosure.

What is claimed is:

1. A generally rectangular container adapted for stacking with another like container at three different levels comprising a generally horizontally disposed bottom, and first and second opposed sidewalls projecting upwardly from the opposing first and second sides of said bottom, respectively, with each of said first and second sidewalls comprising:

a border flange extending along the respective first or second opposite side of the bottom and being vertically disposed in a first vertical plane adjoining said respective side of said bottom, an upper rim being vertically disposed above and in a second vertical plane outside and parallel to that of said first vertical plane, a plurality of bar members extending vertically in a third vertical plane in an upwardly direction between the outer surface of said border flange and the inner surface of said upper rim, said bar members in one of said first and second opposed sidewalls being arranged with respect to the bar members and spacing thereof in the opposite of said first and second sidewalls so that another like container, when reversely oriented with respect to said container, will stack inside said container in a low stack position, a plurality of spaced-apart stacking feet on the outer surface of the bottom flange, a plurality of stacking saddles on the inner surface of said rim spaced above said stacking feet for registering in vertical alignment with said plurality of stacking feet of a like container placed upon said container in a like orientation so that the upper like oriented like container will stack inside said container in an intermediate stack position, said stacking feet and said stacking saddles being of such dimensions and so positioned as not to prohibit a like container from being placed in said container in said low stack position, and a pivotable bar means extending along and mounted to said rim, said bar means being capable of resting upon at least some of said stacking saddles inside said rim and being of such dimensions that when said bar means so rests upon said stacking saddles, another like oriented or reversely oriented like container will stack upon said bar means of said container in a high stack position, said bar means further being capable of being pivoted to a point which will allow a like container to be stacked in said container in either low stack or intermediate stack position.

2. A container according to claim 1 wherein the stacking saddles are provided on the tops of at least some of said bars of said first and second sidewalls and the stacking feet are provided on the bottoms of at least some of said bars of said first and second sidewalls.

3. A container according to claim 2 having third and fourth opposed sidewalls which will allow stacking of two such containers in the low stack, intermediate stack, and high stack positions.

4. A container according to claim 3 wherein said third and fourth opposed sidewalls each includes a border flange adjoining the border flange of the first and second sidewalls and extending along the respective third or fourth opposite sides of the bottom and being disposed in a first vertical plane located adjacent said respective side of said bottom, said third sidewall includes a pair of partial upper rim members disposed above and in a vertical plane outside and parallel to the plane in which said third sidewall border flange is disposed, one said partial upper rim member adjoining the upper rim of the first sidewall and the other said partial upper rim member adjoining the upper rim of the second sidewall, each said partial rim member being of such length that it extends less than half the distance between the adjoining first and second sidewall rims, at least one vertically disposed bar extending in an upwardly direction from the outer surface of said third sidewall border flange to the inner surface of each said respective partial upper rim member, said fourth sidewall includes an upper rim disposed above and in a vertical plane outside and parallel to the plane in which said fourth sidewall border flange is disposed, and a plurality of spaced-apart bar members extending vertically in an upwardly direction between the outer surface of said fourth sidewall border flange and the inner surface of said fourth sidewall rim, said bar members of said fourth sidewall being arranged with respect to the bar members in the third sidewall so that another like container will stack inside said container in a low stack position when reversely oriented with respect to said container.

5. A container according to claim 4 wherein the border flanges of said first and second sidewalls project downwardly below the lower surface of the bottom member.

6. A container according to claim 5 wherein said pivotable bar means of said first and second sidewalls each has the slot on the surface which is uppermost when said pivotable bar is resting on said stacking saddles, said slots being disposed immediately above said respective sidewall border flange and having length and width of the bottom of the respective sidewall border flange.

7. A container according to claim 6 wherein said pivotable bar means of said first and second sidewalls are adapted to pivot from resting upon said stacking saddles to resting against the outside surface of said respective sidewall rim.

8. A container according to claim 6 wherein said pivotable bar means of said first and second sidewalls are adapted to pivot only from resting upon said stacking saddles to a vertical position in the same vertical plane as the respective sidewall.

9. A container according to claim 8 wherein the upper rim of said fourth sidewall and the partial upper rim of said third sidewall have dimensions such that when the pivotable bars are in their vertical position and a like reversely oriented container is placed in said container the uppermost surface of said pivotable bars will contact the lowermost surface of the first and second sidewall rims of the upper container, the uppermost surface of the partial upper rims of the third sidewall will contact the lowermost surface of the fourth sidewall upper rim of the upper container, and the uppermost surface of the fourth sidewall will contact the lowermost surface of the partial upper rim members of the third sidewall of the upper container.

10. A container according to claim 6 wherein said pivotable bar means are adapted to pivot only from resting upon said stacking saddles to a position no greater than 180° from the position of resting upon said stacking saddles.

11. A container according to claim 10 wherein said pivotable bar means are adapted to pivot only from resting upon said stacking saddles to a position no greater than 120° from the position of resting upon said stacking saddles.

12. A container according to claim 11 wherein the uppermost surfaces of said pivotable bars, when resting upon the stacking saddles and the uppermost surface of all four sidewalls, all lie in the same horizontal plane.

13. A container according to claim 12 wherein the lowermost surface of all four sidewalls lies in the same horizontal plane and said third and fourth sidewall border flanges each have notches adjacent their junction with said first and second sidewall border flanges, said notches being of such size and so placed that lower portions of said border flanges of said first and second walls will fit into the slot of a like container having its pivotable bars resting upon the stacking saddles.

14. A container according to claim 13 wherein all four border flanges project upwardly above the top surface of the bottom.

15. A container according to claim 14 wherein all four border flanges project upwardly throughout their length to the same height.

16. A container according to claim 14 wherein the border flanges of the first, second and fourth sidewalls each project upwardly throughout their length to the same height and the border flange of the third sidewall at least throughout the length of its central portion projects upward to a lower height.

17. A container according to claim 16 wherein the central portion of the third sidewall projects upwardly to a height less than about one-half the height of the border flanges of the first, second and fourth sidewalls and wherein the end portions of the third sidewall project upwardly to the same height as that of the border flanges of the first, second and fourth sidewalls.

18. A container according to claim 17 wherein the lower surfaces of the upper rims and the partial upper rim members throughout their lengths thereof lie in the same horizontal plane.

19. A container according to claim 16 wherein the portions of the sidewall that are below the sidewall partial upper rim members project upwardly to the same height as that of the border flanges of the first, second and fourth sidewalls, the remaining central portion of the third sidewall border flange projects upwardly to lower height, and each partial upper rim member has adjacent the end opposite that adjoins the respective first and second sidewall a vertically disposed bar extending upwardly between the outer surface of said third sidewall border flange and the inner surface of said respective partial upper rim member.

20. A container according to claim 19 wherein the lower surfaces of the upper rims and the partial upper rim members throughout their lengths thereof lie in the same horizontal plane.

21. A container according to claim 20 wherein portions of upper rims of said first and second sidewalls are adapted to prevent the pivotable bar attached thereto from pivoting outward more than 120° from the position where said pivotable bar rests upon said stacking saddles.

22. A container according to claim 20 wherein portions of the pivotable bar are adapted to contact the upper rims of said first and second sidewalls to prevent the pivotable bar attached thereto from pivoting outward more than 120° from the position where said pivotable bar rests upon said stacking saddles.

23. A generally rectangular container adapted for stacking with another like container at three different levels comprisng a generally horizontally disposed bottom, and first and second opposed sidewalls projecting upwardly from the opposing first and second sides of said bottom, respectively, with each of said first and second sidewalls comprising:

a border flange extending along the respective first or second opposite side of the bottom and being vertically disposed in a first vertical plane adjoining said respective side of said bottom, an upper rim being vertically disposed above and in a second vertical plane outside and parallel to that of said first vertical plane, a plurality of bar members extending in a third vertical plane in an upwardly direction between the outer surface of said border flange and the inner surface of said upper rim, said bar members in one of said first and second opposed sidewalls being arranged with respect to the bar members and the spacing thereof in the opposite of said first and second sidewalls so that another like container when like oriented will stack inside said container in a low stack position, a plurality of spaced-apart stacking feet on the outer surface of the bottom flange, a plurality of stacking saddles on the inner surface of said rim spaced above said stacking feet for registering in vertical alignment with said plurality of stacking feet of a like container placed upon said container in a reverse orientation so that the upper reversely oriented like container will stack inside said container in an intermediate stack position, said stacking feet and said stacking saddles being of such dimensions and so positioned as not to prohibit a like container from being placed in said container in said low stack position, and a pivotable bar means extending along and mounted to said rim, said bar means being capable of resting upon at least some of said stacking saddles inside said rim and being of such dimensions that when said bar means so rests upon said stacking saddles, another like oriented or reversely oriented like container will stack upon said bar means of said container in a high stack position, said bar means further being capable of being pivoted to a point which will allow a like container to be stacked in said container in either low stack or intermediate stack position.

24. A container according to claim 23 wherein the stacking saddles are provided on the tops of at least some of said bars of said first and second sidewalls and the stacking feet are provided on the bottoms of at least some of said bars of said first and second sidewalls.

25. A container according to claim 24 having third and fourth opposed sidewalls which will allow stacking of two such containers in the low stack, intermediate stack, and high stack positions.

26. A container according to claim 25 wherein said third and fourth opposed sidewalls each comprises, a border flange extending along the respective side of said bottom in a first vertical plane, a pair of partial upper rim members disposed above said border flange in a vertical plane outside and parallel to the plane of the respective border flange, one said partial upper rim member adjoining the upper rim of the second sidewall and the other said partial rim member adjoining the upper rim of the first sidewall, and each partial rim member being of such length that it extends less than half the distance between the adjoining first and second sidewall rims, and a pair of inclined brace members each lying in the same vertical plane as the partial upper rim members and extending from the end of the partial upper rim members opposite that which adjoins the respective first and second sidewall downward toward the other to adjoin the border flange, such that a like oriented like container could be placed inside said container in the low stack position.

27. A generally rectangular container adapted for stacking with another like container at three different levels comprisng a generally horizontally disposed bottom, and first and second opposed sidewalls projecting upwardly from the opposing first and second sides of said bottom, respectively, with each of said first and second sidewalls comprising:

a border flange extending along the respective first or second opposite side of the bottom and being vertically disposed in a first vertical plane adjoining said respective side of said bottom, an upper rim being vertically disposed above and in a second vertical plane outside and parallel to that of said first vertical plane, a plurality of bar members extending upwardly in a third vertical plane between the outer surface of said border flange and the inner surface of said upper rim, said bar members in one of said first and second opposed sidewalls being arranged with respect to the bar members and spacing thereof in the opposite of said first and second sidewalls so that another like container will stack inside said container in a low stack position either when like oriented or when reversely oriented, a plurality of spaced-apart stacking feet on the outer surface of the bottom flange, a plurality of stacking saddles on the inner surface of said rim spaced above said stacking feet, said stacking feet and said stacking saddles being of such dimensions and so positioned as not to prohibit a like container from being placed in said container in a low stack position and so as to allow a like container to stack in an intermediate stack position wherein the stacking feet of the like container register in vertical alignment with the stacking saddles of said container when said like container is placed upon said container in an orientation reverse to that which allows said like container to stack in said container in the low stack position, a pivotable bar means extending along and mounted to said rim, said bar means being capable of resting upon at least some of said stacking saddles inside said rim and being of such dimensions that when said bar means so rests upon said stacking saddles, another like oriented or reversely oriented like container will stack upon said bar means of said container in a high stack position, said bar means further being capable of being pivoted to a point which will allow a like container to be stacked in said container in either low stack or intermediate stack position.

* * * * *